US011678739B1

(12) United States Patent
Retemiah

(10) Patent No.: US 11,678,739 B1
(45) Date of Patent: Jun. 20, 2023

(54) VIBRATING SOAP OR LOTION DISPENSING BATH BRUSH

(71) Applicant: Joel Retemiah, Douglasville, GA (US)

(72) Inventor: Joel Retemiah, Douglasville, GA (US)

( * ) Notice: Subject to any disclaimer, the term of this patent is extended or adjusted under 35 U.S.C. 154(b) by 414 days.

(21) Appl. No.: 17/114,631

(22) Filed: Dec. 8, 2020

(51) Int. Cl.

| | |
|---|---|
| ***A46B 13/04*** | (2006.01) |
| ***A46B 13/02*** | (2006.01) |
| ***A47K 7/04*** | (2006.01) |
| ***A46B 11/00*** | (2006.01) |

(52) U.S. Cl.
CPC ..... *A46B 13/04* (2013.01); *A46B 11/0055* (2013.01); *A46B 13/023* (2013.01); *A47K 7/043* (2013.01); *A46B 2200/1006* (2013.01)

(58) Field of Classification Search
CPC ... A46B 11/0055; A46B 13/023; A46B 13/04; A46B 15/0055; A46B 15/0075; A47K 7/043
USPC ..... 15/21.1, 22.2, 110
See application file for complete search history.

(56) References Cited

U.S. PATENT DOCUMENTS

| | | | |
|---|---|---|---|
| 1,818,281 | A | 8/1931 | Mark |
| 2,739,328 | A | 3/1956 | Bernier |
| 3,055,040 | A | 9/1962 | Schermerhorn |
| D703,825 | S | 4/2014 | Barrett |
| 8,888,395 | B1 | 11/2014 | Hinnant |
| 9,212,039 | B1 | 12/2015 | Reidy |
| 2014/0196227 | A1 | 7/2014 | Cooper |

FOREIGN PATENT DOCUMENTS

| | | |
|---|---|---|
| WO | 1987000425 | 1/1987 |

*Primary Examiner* — Michael D Jennings
*Assistant Examiner* — Aaron R McConnell
(74) *Attorney, Agent, or Firm* — Kyle A. Fletcher, Esq.

(57) ABSTRACT

The vibrating soap or lotion dispensing bath brush comprises a brush body, a bristle attachment, and a soap holder. The bath brush may be adapted to brush skin of a user with a plurality of bristles located on the bristle attachment. As a non-limiting example, the bath brush may ease the task of washing hard to reach areas, such as the user's back. The bath brush may dispense a grooming product from a product dispenser located within the brush body. As a non-limiting example, the grooming product may be liquid soap or a lotion. A bar of soap may be removably coupled to the soap holder. The bath brush may be adapted to rub the bar of soap on the skin.

19 Claims, 5 Drawing Sheets

VIBRATING SOAP OR LOTION DISPENSING BATH BRUSH

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the fields of personal hygiene accessories, more specifically, a vibrating soap or lotion dispensing bath brush.

Summary of Invention

The vibrating soap or lotion dispensing bath brush comprises a brush body, a bristle attachment, and a soap holder. The bath brush may be adapted to brush skin of a user with a plurality of bristles located on the bristle attachment. As a non-limiting example, the bath brush may ease the task of washing hard to reach areas, such as the user's back. The bath brush may dispense a grooming product from a product dispenser located within the brush body. As a non-limiting example, the grooming product may be liquid soap or a lotion. A bar of soap may be removably coupled to the soap holder. The bath brush may be adapted to rub the bar of soap on the skin.

An object of the invention is to provide a bath brush for use while washing the skin of a user.

Another object of the invention is to dispense a grooming product from between a plurality of bristles.

A further object of the invention is to provide a vibrator that may be energized using an operator control located on the handle.

Yet another object of the invention is to provide a soap holder for bar soap on the head of the brush opposite the bristles.

These together with additional objects, features and advantages of the vibrating soap or lotion dispensing bath brush will be readily apparent to those of ordinary skill in the art upon reading the following detailed description of the presently preferred, but nonetheless illustrative, embodiments when taken in conjunction with the accompanying drawings.

In this respect, before explaining the current embodiments of the vibrating soap or lotion dispensing bath brush in detail, it is to be understood that the vibrating soap or lotion dispensing bath brush is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the vibrating soap or lotion dispensing bath brush.

It is therefore important that the claims be regarded as including such equivalent construction insofar as they do not depart from the spirit and scope of the vibrating soap or lotion dispensing bath brush. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Figure 1:
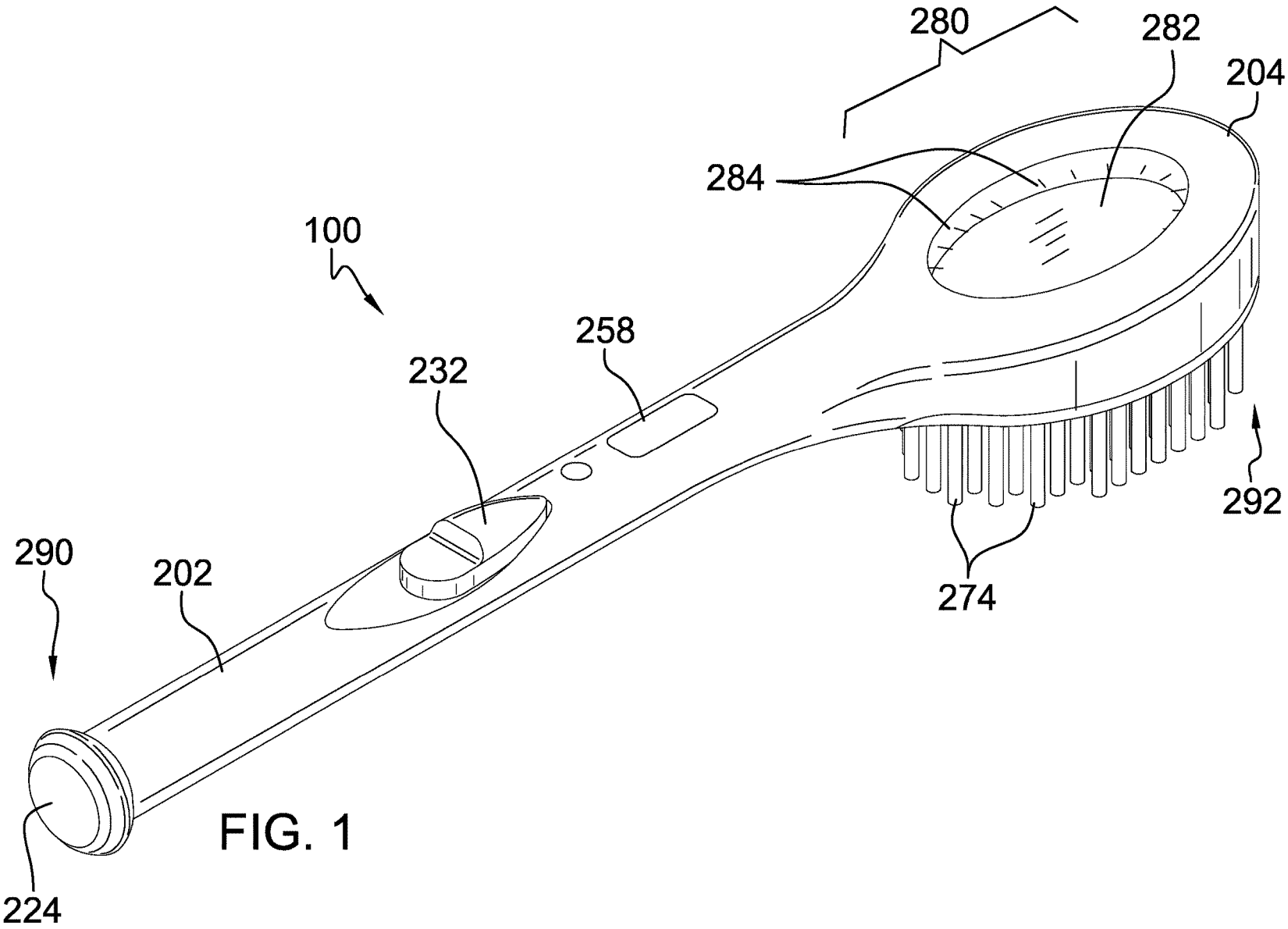
FIG. 1 is an isometric view of an embodiment of the disclosure.
Figure 2:
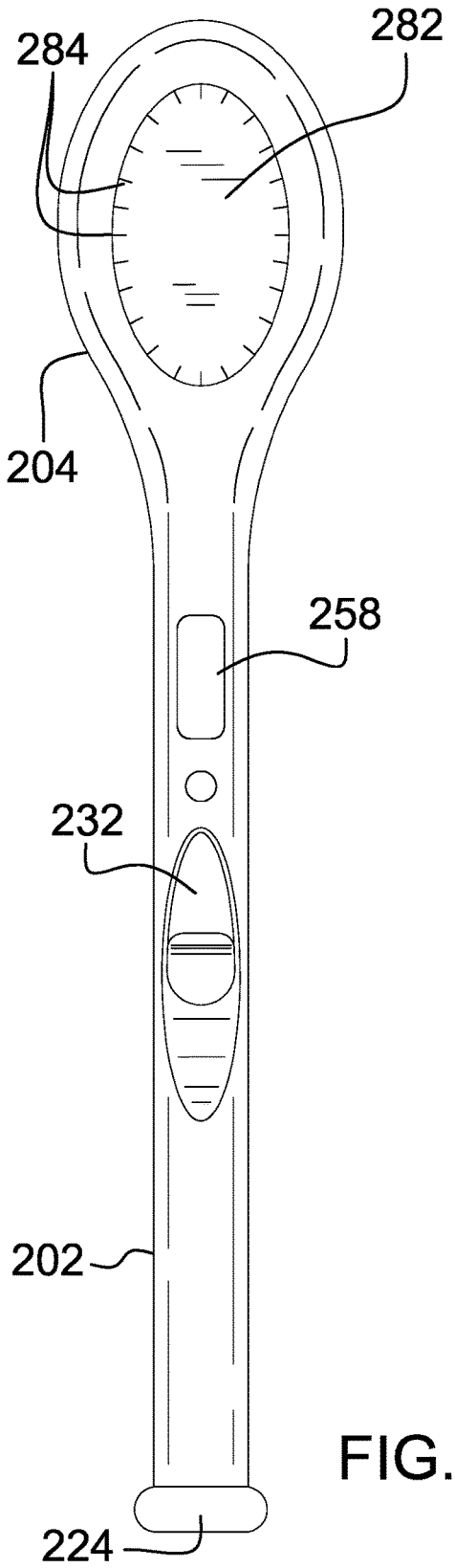
FIG. 2 is a top view of an embodiment of the disclosure.
Figure 3:
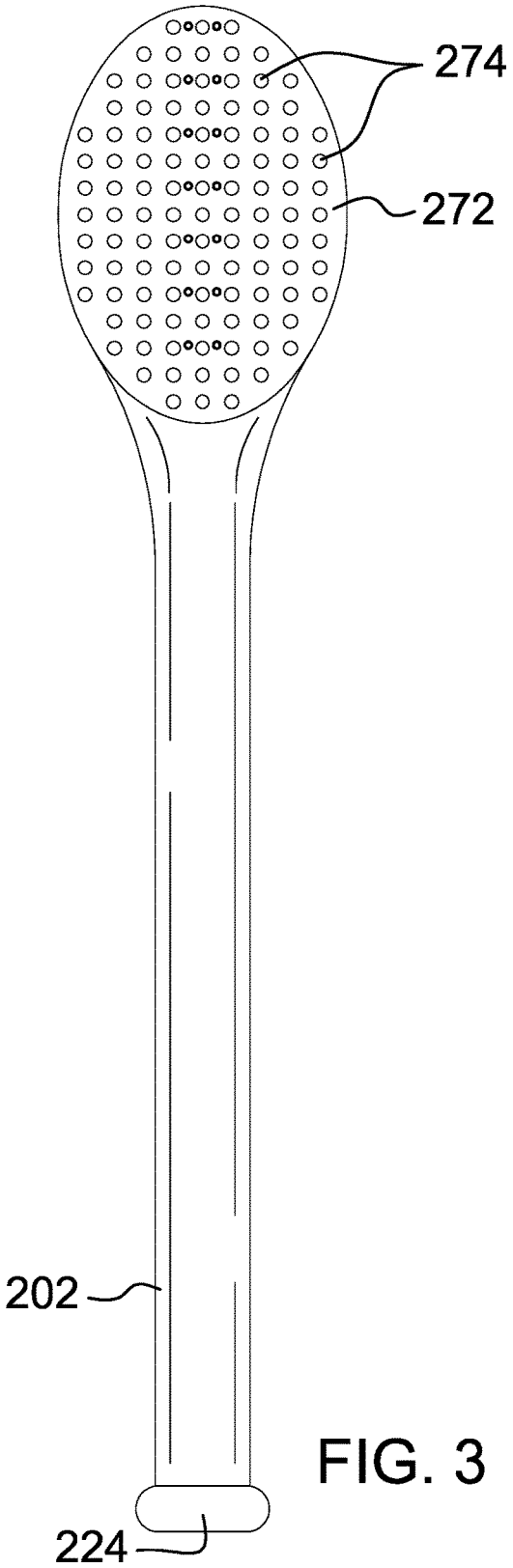
FIG. 3 is a bottom view of an embodiment of the disclosure.
Figure 4:
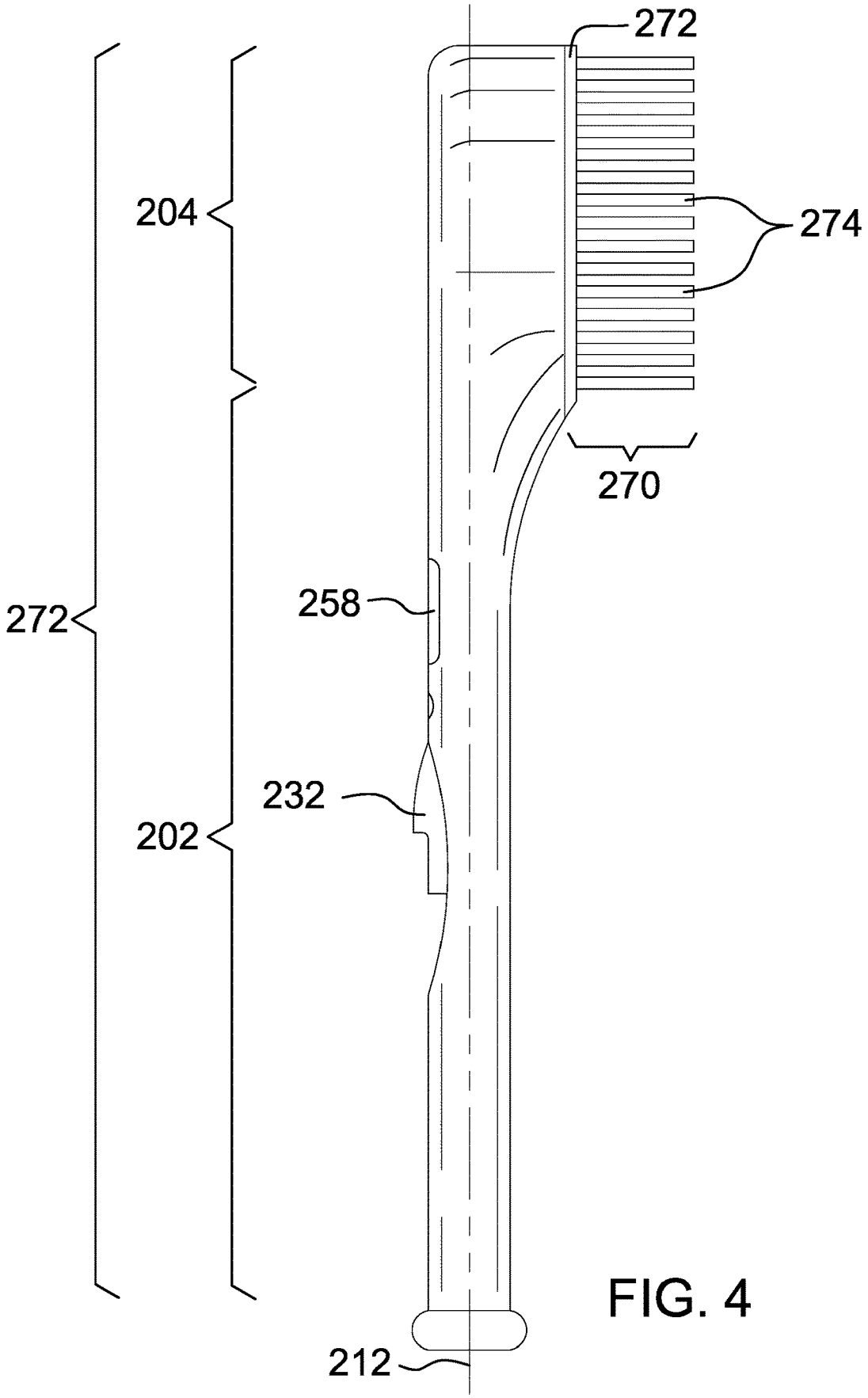
FIG. 4 is a side view of an embodiment of the disclosure.
Figure 5:
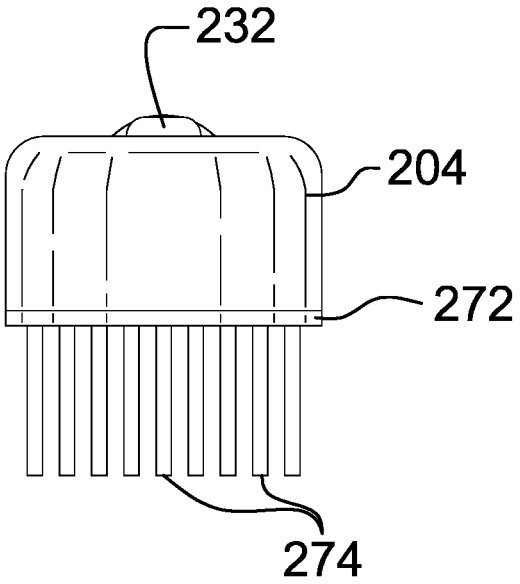
FIG. 5 is a distal end view of an embodiment of the disclosure.
Figure 6:
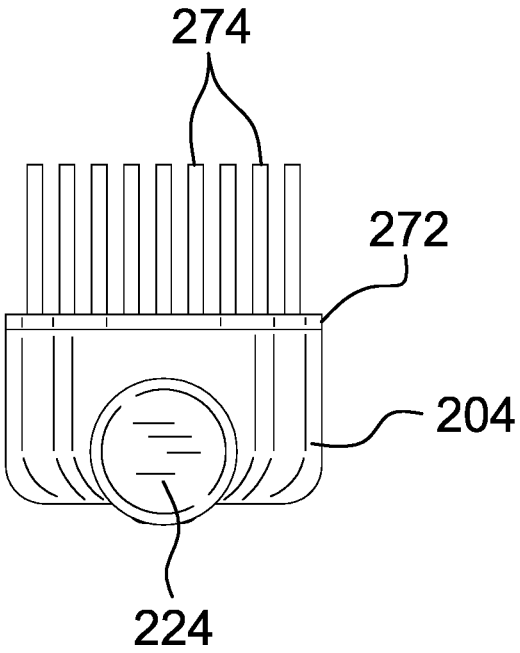
FIG. 6 is a proximal end view of an embodiment of the disclosure.
Figure 7:
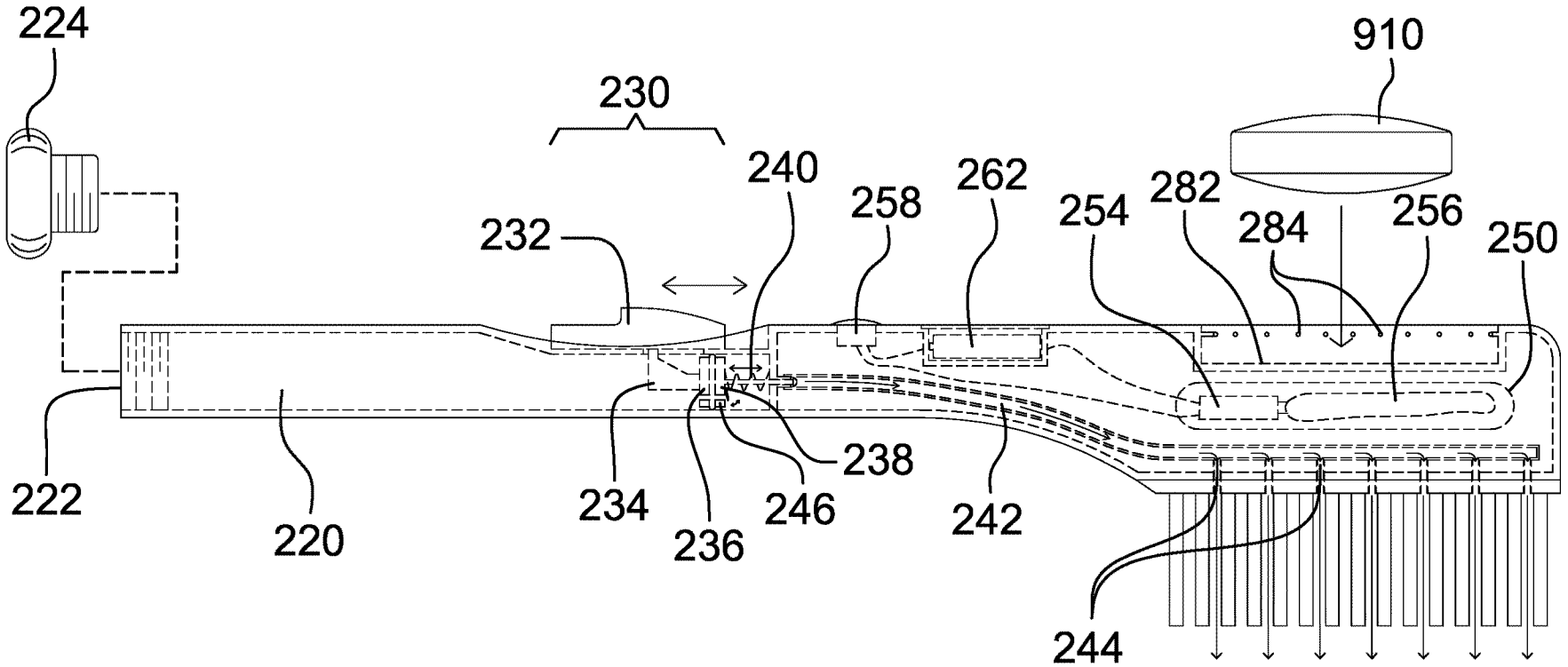
FIG. 7 is a detail view of an embodiment of the disclosure.

Detailed reference will now be made to a first potential embodiment of the disclosure, which is illustrated in FIGS. 1 through 7.

The vibrating soap or lotion dispensing bath brush 100 (hereinafter invention) comprises a brush body 200, a bristle attachment 270, and a soap holder 280. The invention 100 may be adapted to brush skin of a user with a plurality of bristles 274 located on the bristle attachment 270. As a non-limiting example, the invention 100 may ease the task of washing hard to reach areas, such as the user's back. The invention 100 may dispense a grooming product from a product dispenser located within the brush body 200. As a non-limiting example, the grooming product may be liquid soap or a lotion. A bar of soap 910 may be removably coupled to the soap holder 280. The invention 100 may be adapted to rub the bar of soap 910 on the skin.

The brush body 200 may comprise a handle 202, a brush head 204, the product dispenser, and a vibrator 250. The handle 202 may be a cylindrical shaft that is adapted to be held by the user. The brush head 204 may be a widened distal end 292 of the brush body 200 that is coupled to the handle 202. The bottom of the brush head 204 may be adapted to accept the bristle attachment 270.

The product dispenser may comprise a reservoir 220, a pump 230, a dispensing channel 242, and a plurality of dispensing apertures 244. The product dispenser may dispense the grooming product when activated. The reservoir 220 may be a chamber located within the handle 202. The reservoir 220 may store the grooming product that is to be dispensed. In some embodiments, the grooming product may be introduced into the reservoir 220 via a fill aperture 222 that is exposed by removing an end cap 224 located at proximal end 290 of the handle 202.

The pump 230 may comprise an activator 232, a piston arm 234, a piston 236, a valve 238, and a spring 240. The pump 230 may force the grooming product from the reservoir 220 into the dispensing channel 242 when activated. The activator 232 may be accessible on the outside of the handle 202. The pump 230 may be adapted to be activated when the user slides the activator 232 distally. The piston arm 234 may couple the activator 232 to the piston 236 such that movement of the activator 232 results in corresponding movement of the piston 236. The valve 238 may prevent the grooming product from exiting the reservoir 220 unless the valve 238 is displaced by the piston 236. Distal movement of the piston 236 may displace the valve 238 by pushing the valve 238 away from a valve aperture 246, may force the grooming product through the valve aperture 246, or both such that the grooming product may be forced into the dispensing channel 242. The spring 240 may be operable to push the valve 238 and the piston 236 towards the proximal end 290 of the handle 202 in the absence of an activating force applied to the activator 232.

The dispensing channel 242 may be a conduit for the grooming product to move from the reservoir 220 to the plurality of dispensing apertures 244. The plurality of dispensing apertures 244 may be located on the underside of the brush head 204. The plurality of dispensing apertures 244 may be operable to release the grooming product from the brush head 204.

The vibrator 250 may comprise an electromechanical shaker, an operator control 258, and a battery 262. The vibrator 250 may be operable to induce a quivering motion in the brush head 204. The quivering motion may assist in spreading the grooming product onto the skin, may create a pleasurable massage sensation, or both.

In some embodiments, the electromechanical shaker may comprise an electric motor 254 and an unbalanced mass 256. The electric motor 254 may convert electrical energy into mechanical energy. The electric motor 254 may cause rotary motion of the unbalanced mass 256 when electrical energy is applied to the electric motor 254. The unbalanced mass 256 may oscillate when rotated because of the center of gravity of the unbalanced mass 256 is not aligned with the center of rotation of the unbalanced mass 256.

The operator control 258 may control the ON/OFF state of the electromechanical shaker by completing or breaking a circuit between the electric motor 254 and the battery 262. As a non-limiting example, the operator control 258 may be an electrical switch.

The battery 262 may comprise one or more energy-storage devices. The battery 262 may be a source of electrical energy to operate the electric motor 254. The battery 262 may be replaceable or rechargeable.

The bristle attachment 270 may comprise a bristle base 272 and the plurality of bristles 274. The bristle attachment 270 may removably couple to the underside of the brush head 204. As a non-limiting example, the bristle attachment 270 may snap-fit onto the brush head 204. The bristle attachment 270 may be available in multiple configurations to provide a variety of bristle patterns and bristle material. The bristle base 272 may be a frame for holding the plurality of bristles 274 and for detachably coupling to the brush head 204. The plurality of bristles 274 may be semi-rigid spines projecting downwards from the bristle base 272. The tips of the plurality of bristles 274 may be adapted to rub against the skin. The plurality of bristles 274 may be positioned such that the plurality of bristles 274 do not block the plurality of dispensing apertures 244.

The soap holder 280 may comprise an inset 282 and a plurality of tines 284. The soap holder 280 may be operable to hold the bar of soap 910 to the top side of the brush head 204. The invention 100 may be adapted to be held in a first orientation to apply the plurality of bristles 274 to the skin and in a second orientation to apply the bar of soap 910 to the skin. The first orientation may be a 180 degree rotation of the invention 100 around a longitudinal axis 212 of the invention 100 compared to the second orientation. The inset 282 may be a hollow indentation in the top of the brush head 204. The plurality of tines 284 may be rigid or semirigid projections from the brush head 204 radiating into the center of the inset 282 such that the bar of soap 910 may be pressed into the plurality of tines 284 to retain the bar of soap 910 on the invention 100.

In use, the end cap 224 at the proximal end 290 of the handle 202 may be removed, the grooming product may be poured into the reservoir 220, and the end cap 224 may be replaced. The invention 100 may be positioned to place the plurality of bristles 274 against the skin and the invention 100 may be moved over the surface of the skin. As a non-limiting example, the plurality of bristles 274 may be placed against the user's back. The grooming product may be dispensed through the plurality of bristles 274 when the activator 232 is activated. The vibrator 250 may be energized using the operator control 258 to assist in distributing the grooming product over the skin and/or to massage the skin. The invention 100 may be moved to apply the bar of soap 910 to the skin. The bar of soap 910 may be placed into the soap holder 280 and the invention 100 may be rotated 180 degrees to place the bar of soap 910 against the skin.

DEFINITIONS

Unless otherwise stated, the words "up", "down", "top", "bottom", "upper", and "lower" should be interpreted within a gravitational framework. "Down" is the direction that gravity would pull an object. "Up" is the opposite of "down". "Bottom" is the part of an object that is down farther than any other part of the object. "Top" is the part of an object that is up farther than any other part of the object. "Upper" may refer to top and "lower" may refer to the bottom. As a non-limiting example, the upper end of a vertical shaft is the top end of the vertical shaft.

As used in this disclosure, an "aperture" may be an opening in a surface. Aperture may be synonymous with hole, slit, crack, gap, slot, or opening.

Throughout this document the terms "battery", "battery pack", and "batteries" may be used interchangeably to refer to one or more wet or dry cells or batteries of cells in which chemical energy is converted into electricity and used as a source of DC power. References to recharging or replacing batteries may refer to recharging or replacing individual cells, individual batteries of cells, or a package of multiple battery cells as is appropriate for any given battery technology that may be used. The battery may require electrical contacts which may not be illustrated in the figures.

As used in this disclosure, a "bristle" may be a short coarse stiff hair or hair like object.

As used in this disclosure, a "brush" may be a device comprising a plurality of bristles set into a handle or a base that is used for grooming, sweeping, smoothing, scrubbing, cleaning, or painting.

As used in this disclosure, a "channel" may be a tubular passage through which an object or fluid is passed through.

As used in this disclosure, a "conduit" may be a tube, pipe or hose that is used to transport a fluid or a gas or is used to route, enclose, and protect permanently installed electrical cables.

As used herein, the words "control" or "controls" are intended to include any device which can cause the completion or interruption of an electrical circuit; non-limiting examples of controls include toggle switches, rocker switches, push button switches, rotary switches, electromechanical relays, solid state relays, touch sensitive interfaces and combinations thereof whether they are normally open, normally closed, momentary contact, latching contact, single pole, multi-pole, single throw, or multi-throw.

As used herein, the words "couple", "couples", "coupled" or "coupling", may refer to connecting, either directly or indirectly, and does not necessarily imply a mechanical connection.

As used in this disclosure, the terms "distal" and "proximal" may be used to describe relative positions. Distal refers to the object, or the end of an object, that is situated away from the point of origin, point of reference, or point of attachment. Proximal refers to an object, or end of an object, that is situated towards the point of origin, point of reference, or point of attachment. Distal implies 'farther away from' and proximal implies 'closer to'. In some instances, the point of attachment may be the where an operator or user of the object makes contact with the object. In some instances, the point of origin or point of reference may be a center point, a central axis, or a centerline of an object and the direction of comparison may be in a radial or lateral direction.

As used in this disclosure, an "electric motor" may be a device that converts electric energy into rotational mechanical energy.

As used herein, "front" may indicate the side of an object that is closest to a forward direction of travel under normal use of the object or the side or part of an object that normally presents itself to view or that is normally used first. "Rear" or "back" may refer to the side that is opposite the front.

As used herein, "handle" may refer to an object by which a tool, object, or door is held or manipulated with the hand.

As used herein, the word "longitudinal" or "longitudinally" may refer to a lengthwise or longest direction.

As used in this disclosure, a "motor" may refer to a device that transforms energy from an external power source into mechanical energy.

As used in this disclosure, "orientation" may refer to the positioning and/or angular alignment of a first object relative to a second object or relative to a reference position or reference direction.

As used herein, "reservoir" may refer to a container or containment system that is configured to store a liquid, gas, or gel.

As used herein, "resilient" or "semi-rigid" may refer to an object or material which will deform when a force is applied to it and which will return to its original shape when the deforming force is removed.

As used herein, "rigid" may refer to an object or material which is inflexible. A rigid object may break if force is applied to the object.

As used in this disclosure, a "spring" may be a device that is used to store mechanical energy. This mechanical energy will often be stored by deforming an elastomeric material that is used to make the device, by the application of a torque to a rigid structure, or by a combination thereof. In some embodiments, the rigid structure to which torque is applied may be composed of metal or plastic.

As used in this disclosure, a "switch" may be an electrical device that starts and stops the flow of electricity through an electric circuit by completing or interrupting an electric circuit. The act of completing or interrupting the electrical circuit may be called actuation. Completing or interrupting an electric circuit with a switch is often referred to as closing or opening a switch, respectively. Completing or interrupting an electric circuit is also referred to as making or breaking the circuit, respectively.

As used in this disclosure, a "valve" may be a device that is used to control the flow of a fluid, either gas or liquid, through a pipe or to control the flow of a fluid into and out of a container. Some valves may have multiple ports and may allow the diverting or mixing of fluids.

With respect to the above description, it is to be realized that the optimum dimensional relationship for the various components of the invention described above and in FIGS. 1 through 7, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A vibrating soap or lotion dispensing bath brush comprising:

a brush body, a bristle attachment, and a soap holder;

wherein the vibrating soap or lotion dispensing bath brush is adapted to brush skin of a user with a plurality of bristles located on the bristle attachment;

wherein the vibrating soap or lotion dispensing bath brush dispenses a grooming product from a product dispenser located within the brush body;

wherein a bar of soap is removably coupled to the soap holder;

wherein the vibrating soap or lotion dispensing bath brush is adapted to rub the bar of soap on the skin.

2. The vibrating soap or lotion dispensing bath brush according to claim 1 wherein the brush body comprises a handle, a brush head, the product dispenser, and a vibrator;

wherein the handle is a cylindrical shaft that is adapted to be held by the user;

wherein the brush head is a widened distal end of the brush body that is coupled to the handle.

3. The vibrating soap or lotion dispensing bath brush according to claim 2 wherein the bottom of the brush head is adapted to accept the bristle attachment.

4. The vibrating soap or lotion dispensing bath brush according to claim 3 wherein the product dispenser comprises a reservoir, a pump, a dispensing channel, and a plurality of dispensing apertures;

wherein the product dispenser dispenses the grooming product when activated;

wherein the reservoir is a chamber located within the handle;

wherein the reservoir stores the grooming product that is to be dispensed.

5. The vibrating soap or lotion dispensing bath brush according to claim 4 wherein the grooming product is introduced into the reservoir via a fill aperture that is exposed by removing an end cap located at proximal end of the handle.

6. The vibrating soap or lotion dispensing bath brush according to claim 5 wherein the pump comprises an activator, a piston arm, a piston, a valve, and a spring;

wherein the pump forces the grooming product from the reservoir into the dispensing channel when activated.

7. The vibrating soap or lotion dispensing bath brush according to claim 6 wherein the activator is accessible on the outside of the handle;

wherein the pump is adapted to be activated when the user slides the activator distally.

8. The vibrating soap or lotion dispensing bath brush according to claim 7 wherein the piston arm couples the activator to the piston such that movement of the activator results in corresponding movement of the piston.

9. The vibrating soap or lotion dispensing bath brush according to claim 8 wherein the valve prevents the grooming product from exiting the reservoir unless the valve is displaced by the piston.

10. The vibrating soap or lotion dispensing bath brush according to claim 9 wherein distal movement of the piston displaces the valve by pushing the valve away from a valve aperture, forces the grooming product through the valve aperture, or both such that the grooming product is forced into the dispensing channel.

11. The vibrating soap or lotion dispensing bath brush according to claim 10 wherein the spring is operable to push the valve and the piston towards the proximal end of the handle in the absence of an activating force applied to the activator.

12. The vibrating soap or lotion dispensing bath brush according to claim 11 wherein the dispensing channel is a conduit for the grooming product to move from the reservoir to the plurality of dispensing apertures.

13. The vibrating soap or lotion dispensing bath brush according to claim 12 wherein the plurality of dispensing apertures are located on the underside of the brush head;

wherein the plurality of dispensing apertures are operable to release the grooming product from the brush head.

14. The vibrating soap or lotion dispensing bath brush according to claim 13 wherein the vibrator comprises an electromechanical shaker, an operator control, and a battery;

wherein the vibrator is operable to induce a quivering motion in the brush head.

15. The vibrating soap or lotion dispensing bath brush according to claim 14 wherein the electromechanical shaker comprises an electric motor and an unbalanced mass;

wherein the electric motor converts electrical energy into mechanical energy;

wherein the electric motor causes rotary motion of the unbalanced mass when electrical energy is applied to the electric motor;

wherein the unbalanced mass oscillates when rotated because of the center of gravity of the unbalanced mass is not aligned with the center of rotation of the unbalanced mass.

16. The vibrating soap or lotion dispensing bath brush according to claim 15 wherein the operator control controls the ON/OFF state of the electromechanical shaker by completing or breaking a circuit between the electric motor and the battery.

17. The vibrating soap or lotion dispensing bath brush according to claim 16 wherein the battery comprises one or more energy-storage devices;

wherein the battery is a source of electrical energy to operate the electric motor;

wherein the battery is replaceable or rechargeable.

18. The vibrating soap or lotion dispensing bath brush according to claim 17 wherein the bristle attachment comprises a bristle base and the plurality of bristles;

wherein the bristle attachment removably couples to the underside of the brush head;

wherein the bristle base is a frame for holding the plurality of bristles and for detachably coupling to the brush head;

wherein the plurality of bristles are semi-rigid spines projecting downwards from the bristle base;

wherein the tips of the plurality of bristles are adapted to rub against the skin;

wherein the plurality of bristles are positioned such that the plurality of bristles do not block the plurality of dispensing apertures.

19. The vibrating soap or lotion dispensing bath brush according to claim 18 wherein the soap holder comprises an inset and a plurality of tines;

wherein the soap holder is operable to hold the bar of soap to the top side of the brush head;

wherein the vibrating soap or lotion dispensing bath brush is adapted to be held in a first orientation to apply the plurality of bristles to the skin and in a second orientation to apply the bar of soap to the skin;

wherein the first orientation is a 180 degree rotation of the vibrating soap or lotion dispensing bath brush around a longitudinal axis of the vibrating soap or lotion dispensing bath brush compared to the second orientation;

wherein the inset is a hollow indentation in the top of the brush head;

wherein the plurality of tines are rigid or semirigid projections from the brush head radiating into the center of the inset such that the bar of soap is pressed into the plurality of tines to retain the bar of soap on the vibrating soap or lotion dispensing bath brush.

* * * * *